United States Patent [19]

Asbjornsen et al.

[11] Patent Number: 4,711,492

[45] Date of Patent: Dec. 8, 1987

[54] CHAIR BACK ARRANGEMENT

[76] Inventors: Svein Asbjornsen; Jan Lade, both of N-6230 Sykkylven, Norway

[21] Appl. No.: 866,994

[22] Filed: May 19, 1986

Related U.S. Application Data

[63] Continuation-in-part of Ser. No. 787,362, Oct. 15, 1985, abandoned, which is a continuation of Ser. No. 576,780, Feb. 3, 1984, abandoned, which is a continuation of Ser. No. 339,459, Feb. 22, 1981, abandoned.

[30] Foreign Application Priority Data

May 6, 1980 [NO] Norway ..... 801328

[51] Int. Cl.[4] ..... A47C 3/00

[52] U.S. Cl. ..... 297/284; 297/353; 297/460; 297/422

[58] Field of Search ..... 297/284, 353, 460, 465, 297/447, 422, 450

[56] References Cited

U.S. PATENT DOCUMENTS

| | | | |
|---|---|---|---|
| D. 166,397 | 4/1952 | Komai | 297/457 X |
| 1,236,507 | 8/1917 | Wemple et al. | 297/460 X |
| 2,364,452 | 12/1944 | Kramer | 297/422 |
| 2,764,228 | 9/1956 | Donohue | 297/457 X |
| 3,131,970 | 5/1964 | McGregor | 297/445 |
| 3,279,849 | 10/1966 | Radke et al. | 297/284 |

*Primary Examiner*—Francis K. Zugel
*Attorney, Agent, or Firm*—Ladas & Parry

[57] ABSTRACT

A back (1) for a chair, sofa or the like, adapted for providing a means of securing support pillows (3) thereto, is formed with at least one vertical groove (2) which passes completely through the back. The associated support pillow (3) is formed with a protruding knob (4) on one side thereof, said knob (4) being adapted to fit the groove (2) in such manner that the placement of the pillow (3) on the chair back can be adjusted by guiding the knob (4) up and down in the groove (2), while at the same time the knob (4) holds the pillow (3) secured to the back (1).

14 Claims, 14 Drawing Figures

CHAIR BACK ARRANGEMENT

This is a continuation-in-part application of U.S. patent application Ser. No. 787,362 filed 10,15,85, now abandoned which is the continuation of application of U.S. patent application Ser. No. 576,780 filed 2,3,84 now abandoned which is in turn the continuation of U.S. patent application Ser. No. 339,459 filed 2-22-81 now abandoned.

The invention relates to a chair back arrangement for chairs, sofas and the like, adapted for securing support pillows thereto.

Extra support pillows are often utilized in chairs, sofas and the like, e.g., loose pillows are used to provide support for the small of the back, or a headrest may be attached to the chair back to provide support for the neck and head. A pillow for the small of the back will easily become displaced, while headrests in fixed position on the chair back, fastened thereto by means of snaps or bands, cannot be adjusted to fit persons of varying heights. To date, no satisfactory solution has been provided for securing such pillows to seating furniture, nor for permitting the user to adjust the position of such pillows as desired.

The object of the present invention is to provide a means by which the above desires in regard to the placement of pillows in a piece of seating furniture can be fulfilled.

This object is obtained by a chair back arrangement which is characterized by the features disclosed in the appurtenant patent claims.

In accordance with the invention, the back for the piece of seating furniture is formed with a slot or a groove passing completely through the chair back and extending in the vertical direction. Such a groove can be provided in a simple manner. The back side of the support pillow is provided with a protruding knob of such configuration that the knob can be slidably guided in the groove and at the same time be securely retained on the backrest. The pillow can thus be moved vertically up and down the back of the chair or sofa, permitting one to place a headrest at the desired height as well as, if desired, a back-support pillow which rests against the seat of the chair or sofa. Thus, one or more pillows can be provided as desired, and the pillows can also be individually adjusted so that the user obtains the desired sitting position. The groove in the backrest can extend all the way up and through the top edge of the backrest, so that the pillows can be threaded into and out of the groove in the simplest manner possible, or the groove can be a slot closed at both ends, in which case the knob must be divisible to permit the pillows to be positioned on the chair back. On a sofa, several such pillows can be arranged next to one another along the length of the sofa back. It is of course also possible to use several grooves and knobs, e.g., for larger pillows. A groove which passes completely through the back of the chair has the advantage that dirt and dust can easily be removed and will not collect in the groove.

The invention will be explained in greater detail in the following with reference to embodiment examples as illustrated in the accompanying, schematic drawings, wherein FIG. 1 shows a chair back with a pillow in accordance with the invention, seen from above.

Figure 1:
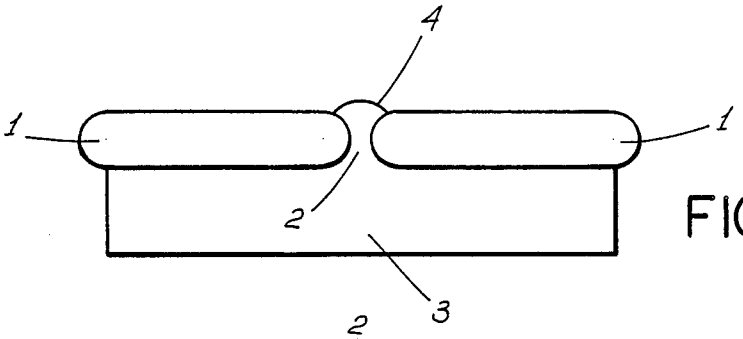
Figure 2:
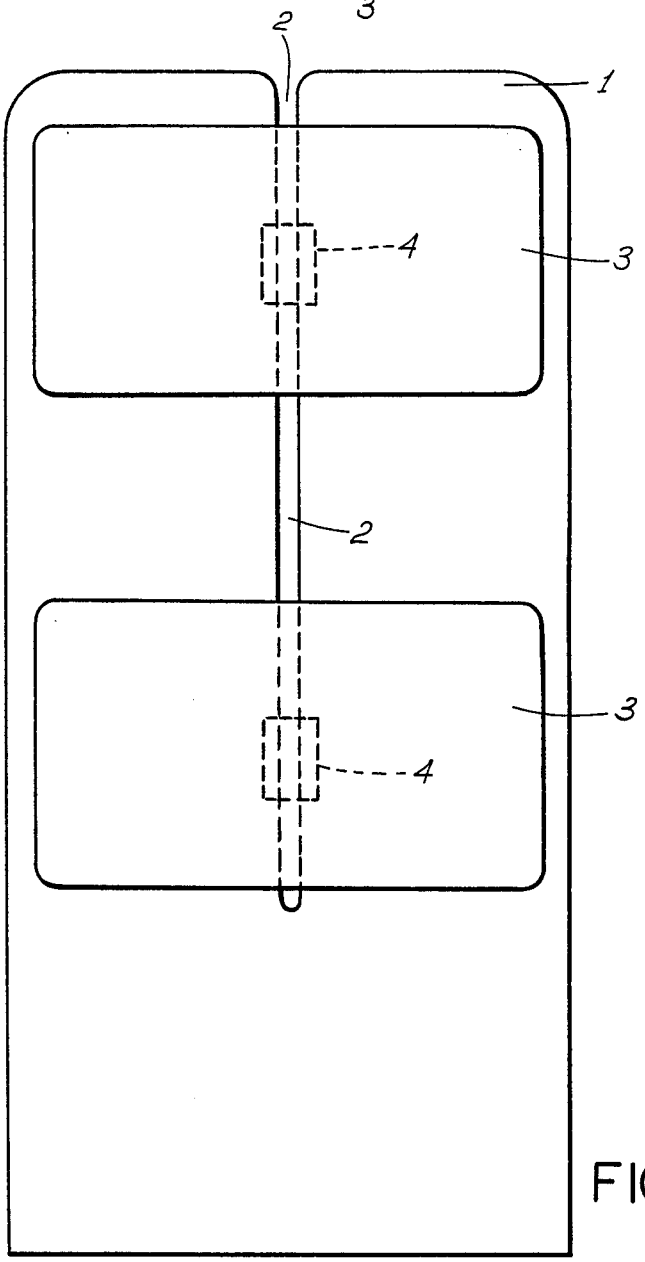
FIG. 2 shows the chair back of FIG. 1 from the front.
Figure 6A:
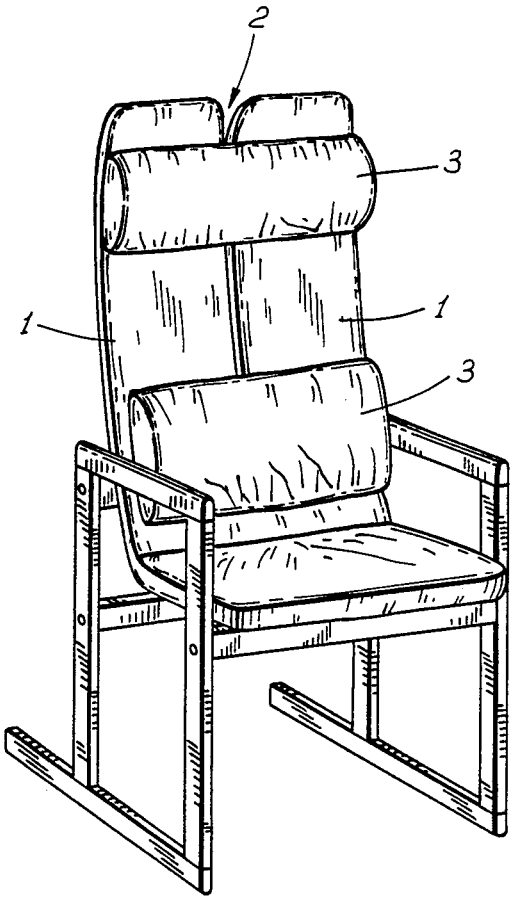
Figure 6B:
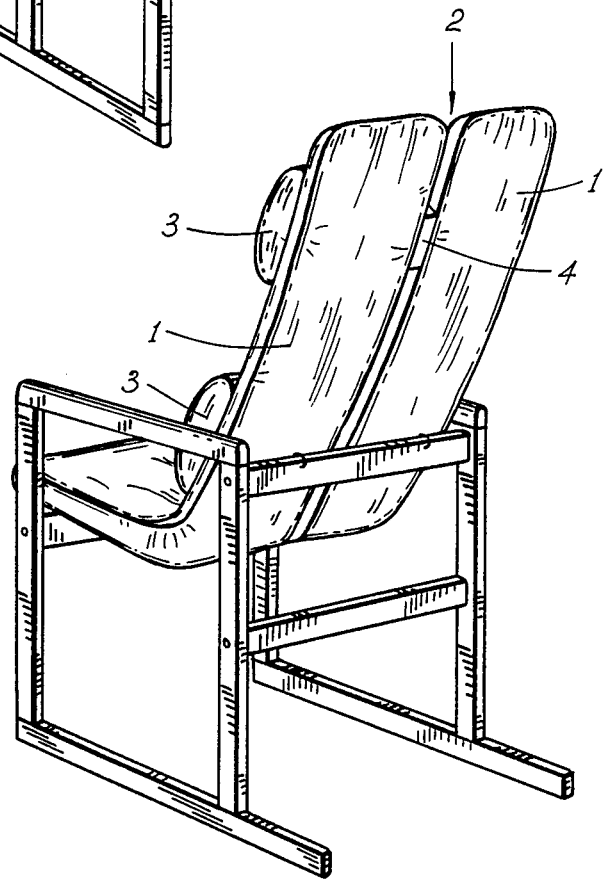
Figure 7:
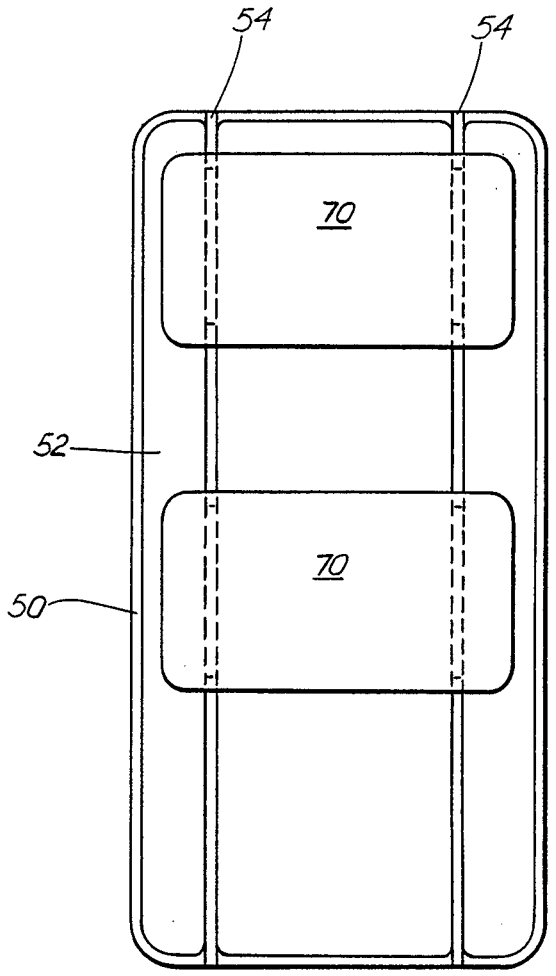
Figure 8:
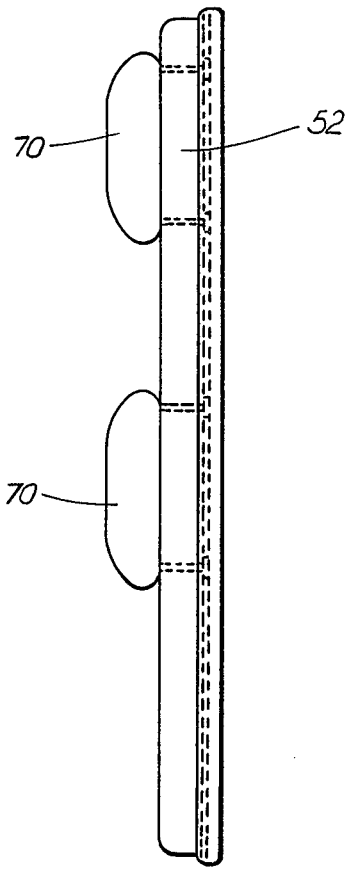
Figure 9:
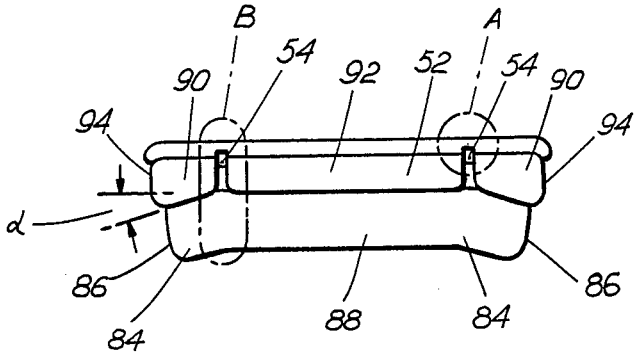
Figure 10:
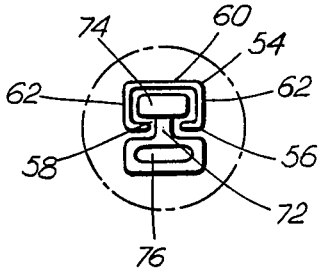
Figure 11:
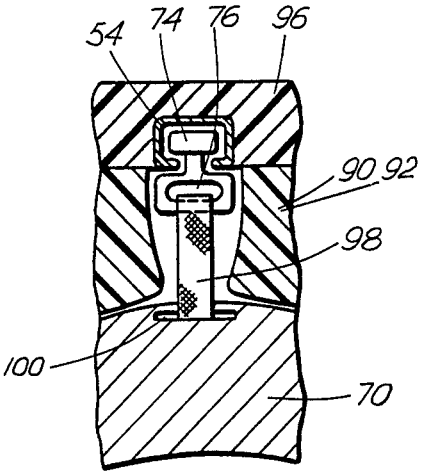
Figure 12:
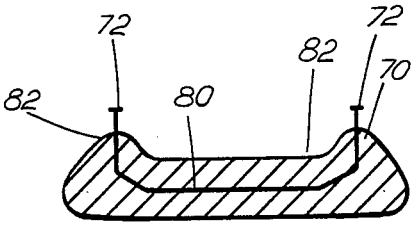
Figure 13:
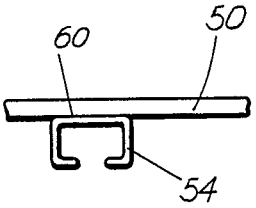

FIGS. 6A and 6B are perspective views of a chair having a back according to FIGS. 1–2, seen from the front and back, respectively, FIG. 7 is a front elevational view of a back of the chair and the support pillow according to another embodiment of the invention; FIG. 8 is the side elevational view of the embodiment shown in FIG. 7; FIG. 9 is the top plan view of the embodiment shown in FIG. 7; FIG. 10 is an enlarged view of the detail A of FIG. 9; FIG. 11 is an enlarged view of the detail B of FIG. 9; FIG. 12 shows another embodiment of the support pillow according to this invention; and FIG. 13 shows a further embodiment of the invention.

Although the present invention has been described with reference to particular embodiments shown in the drawings, it will be apparent to those skilled in the art that variations and modifications can be substituted therefore without departing from the principals and true spirit of the invention.

In the drawings, a back 1 for a chair is illustrated in a strictly schematic manner. This chair back is cut through in the middle by a slot or a groove 2, which in the embodiment shown in FIGS. 1–3 extends from the top edge of the backrest down to the same level as the upper edge of the sitting surface. The groove 2, as shown in FIG. 1, can be formed with a narrower middle section, for example, by giving a rounded configuration to the edge regions of the backrest which face toward the groove.

Secured in the groove 2 are two pillows 3, which have a protruding knob 4 on the back side thereof. The knob is given a form corresponding to the configuration of the groove, and the knob 4 projects a short distance outside the back side of the backrest. With this design, the pillow can be moved up and down in the groove, but at the same time, owing to the configuration of the groove, it will also be held securely in the groove. It will thus be possible to move the pillows into the desired position, and it is a simple matter also to remove one or both of the pillows by sliding the pillow upwardly and removing it from the groove. The chair back can also be used without pillows, since the groove in the back will not form any unevenness which would be uncomfortable for a user of the furniture.

Figure 4:
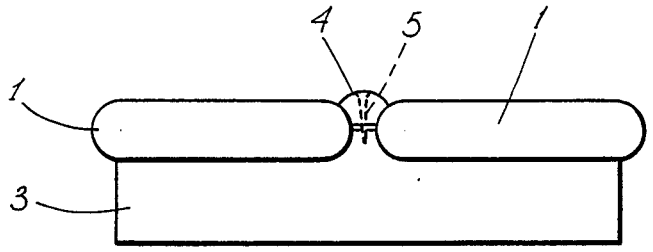
FIG. 4 shows a second embodiment of the invention, seen from above.
Figure 5:
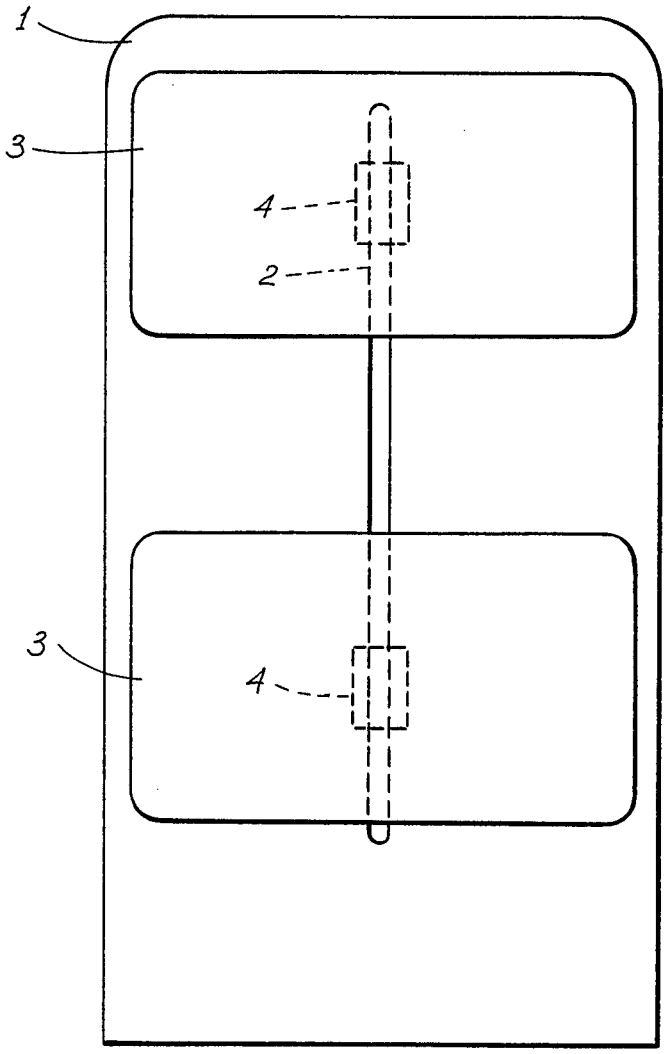
FIG. 5 shows the embodiment of FIG. 4 seen from the front.

FIGS. 4 and 5 show an embodiment in which the groove 2 does not extend all the way up through the top edge of the chair back, but terminates a distance below the edge. With such an embodiment, the protruding knob on the support pillow must be divided so as to permit the pillow to be mounted in the groove. A divided knob is shown in FIG. 4, where the parts are held together following mounting of the pillow by means of a screw 5. This embodiment makes it somewhat more complicated to remove a pillow or all of the pillows from the back of the chair or sofa, but in some cases will be more practical owing to the design and form of the back.

Figure 3:
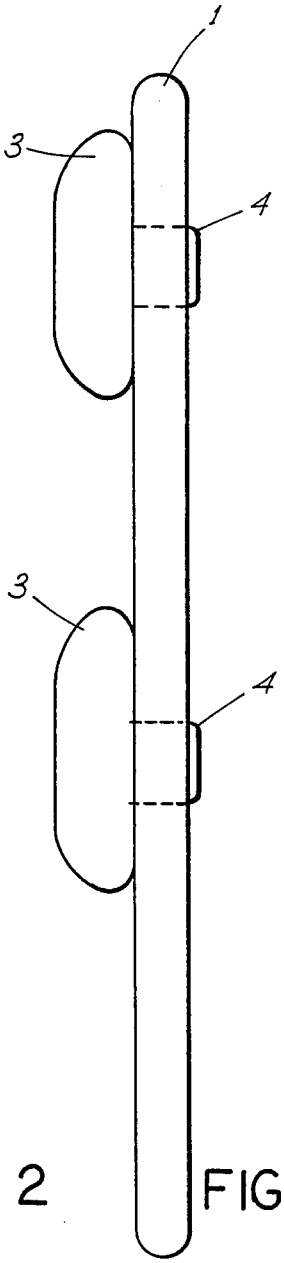
FIG. 3 shows the chair back of FIG. 1 seen from the side.

FIGS. 6A and 6B show an example of a high-backed chair with a back in accordance with FIGS. 1–3.

Many other modifications are possible within the scope of the invention. Thus, the knob 4 and the groove 2 can be given different embodiment configurations, e.g., utilizing undercut grooves, dove-tail joints and the like.

FIG. 7 shows another embodiment of a back portion of the chair. The back portion of the chair 50 can have an upholster part 52 which extends along it's front surface. However, the present embodiment of the invention also can be used without the upholstered part attached to the back of the chair. It is shown in the embodiment of FIG. 7 that the back portion 50 is provided with two receiving means or elongated members 54 having the axial length extending through the entire length of the back portion in the direction substantially parallell it's longitudinal axis A—A. However, in some instances the axial length of the elongated member 54 can be less that the entire length of the back portion 50.

FIG. 10 shows the elongated member 54 having a substantially C-shaped cross-section. The member 54 includes a front wall 56 having an opening 58, a rear wall 60 and two side walls 62 connecting the front and rear walls together. FIG. 9 demonstrates the location of the elongated members 54 within the back portion of the chair 50 in a such manner that almost the entire outside surface of the member 54 is surrounded by the back portion 50 and only the front wall 56 having the opening 58 is exposed to the outside. The member 54 also can be attached to the back portion 50 only by it's rear wall 60 as shown in FIG. 13.

The support pillow means or pillow 70 are provided with engaging means or engaging member 72. The engaging member has an engaging part 74 for engagement with the receiving means 54 and a connecting part 76 for connection with the support pillow 70. FIG. 10 shows the engaging member 72 having a substantially T-shaped configuration. An inside surface of the elongated member 54 is adapted for adjustable receiving of the engaging part 74 of the engaging means in a such manner that the engaging means and the pillow are retained in predetermined position within the elongated member or receiving means by means of resilient forces of engaging means and elongated members and frictional forces between the pillow and the back portion.

As shown in FIG. 11, the connecting part 76 of the engaging means 72 is fixedly secured to the pillow 70. By means of a resilient or elastic member 98 engaging the part 76 and being anchored to the pillow 70 by sewing or by an anchoring means 100, e.g. a button. Suitably the connecting part 76 is made of rigid (non-resilient) material.

In case the rigid connecting part 72 extends into the pillow 70, as indicated by FIG. 12, spring means or resilient member 80 should be provided within the pillow in order to enhance the flexibility of the arrangement. The resilient member is necessary since in the case of rigid connecting part it is more diffucult to shift the pillow along the back portion of the chair.

To improve the ability of the user to adjust position of the support pillow on the back of the chair an area of contact between the pillows and back should be substantially reduced. The present arrangement is designed in a such way that the majority of contacts between the support pillow and the upholstered back portion of the chair are distributed along a portion of a rear surface of the pillow positioned between the engaging means and the side edges of the support pillow. This can be done by letting the cushion 70 have an internal rear backing of relatively rigid, although somewhat resilient material, said backing being curved slightly frontward at the region between the two receiving means. In this case, portions 84 to be discussed below need not have such backing, thus inherently tending to assume an angle $\alpha$ equal to 0°, but prevented therefrom by the portion 90 of upholster part 52 angled at angle $\alpha$. In general the back portion of the chair contacts the support pillow by the part of its upholster 52 positioned between the receiving means 54 and the side edges of the back portion 94. However, with the embodiments of FIGS. 9 and 11, the pillow 70, when being shifted, is pulled away from the upholster part 52. The pulling distance is limited by the maximum stretching of the elastic member 100.

In order to reduce the friction between the pillow and the back portion within the area between two receiving means 54 engaged by two engaging means 72, a recess 102 can be provided within the rear surface of the pillow 70 positioned between two engaging means 72 (see FIG. 12). This design of the pillow 70 almost entirely eliminates friction between the portion of the pillow positioned between two engaging means 72 and the back portion of the chair.

In the embodiment of the invention shown in FIG. 9 portions 84 of the support pillow positioned between engaging means 72 and the side edges 86 are enterposed to the portion 88 of the pillow, positioned between engagine means, at an angle $\alpha$. This angle corresponds to an angle of inclination of the parts 90 of the back of the chair positioned between receiving means 54 and the side edges 94 to the part 92 positioned between two receiving means 54 in the backrest portion. The contacts between the portions 88 and 92 are minimal. Upon adjustment of the position of the pillow 70 on the back portion of the chair 50 the pillow is retained in this predetermined position essentially by the frictional forces which exist between portions 84 of the pillow and 90 of the back portion and resilient forces of engaging and receiving means.

Engaging means and support pillow means are retained in a predetermined position within receiving means by means of resilient and frictional forces of engaging and receiving means and forces existing between support pillow means and the back portion.

We claim:

1. A seating furniture back arrangement comprising a back portion having at least one receiving means attached to said back portion, said receiving means extending along said back portion in the direction substantially parallel to a longitudinal axis of the back portion, support pillow means having engaging means, at least a portion of said engaging means protruded from one side of said support pillow means, said engaging means is adjustably receivable by said receiving means in an assembled condition of the arrangement, said engaging means having an engaging part for engagement with said receiving means and a connecting part for connection of said engaging part to said support pillow means, said receiving means is an elongated member having a substantially C-shaped crossection with a front wall having an opening, a rear wall and at least two side walls connecting said front and rear walls, said engaging means having an engaging part for engagement with said receiving means and an elastic connecting part connecting said engaging part with said support pillow means, said engaging means and said support pillow means are retained in a predetermined position by means of inherent resilient and frictional forces of said engaging and receiving means and inherent mutual forces existing between said support pillow means and said back portion.

2. An arrangement according to claim 1, wherein one end of said elastic connecting part is permanently secured to said pillow means and another end being permanently attached to said engagement part.

3. An arrangement according to claim 1, wherein said elastic connecting part comprises spring means provided within the support pillow means and said engaging part linking said spring means with said receiving means.

4. An arrangement according to claim 1 wherein said elongated member is positioned in a such manner that only the front wall is exposed to the outside.

5. An arrangement according to claim 1 wherein said elongaged member is made of aluminum.

6. An arrangement according to claim 1 wherein only the rear wall of said elongated member is attached to the back portion.

7. An arrangement according to claim 1 wherein said engaging part is protruded from one side of said support pillow means and has a substantially T-shaped configuration.

8. An arrangement according to claim 1 wherein at least a portion of the connecting part is fixedly positioned within said support pillow means.

9. An arrangement according to claim 1 wherein at least the connecting part of said engaging means is made of a resilient material.

10. An arrangement according to claim 1 wherein said engaging means is made of nylon.

11. An arrangement according to claim 1 wherein at least two receiving means are provided within the back portion and at least two engaging means are provided within the support pillow means and said support pillow means contacts said back portion by parts of said support pillow means positioned between said engaging means and side edges of said support pillow means, and wherein contracts of a portion of said support pillow means positioned between said engaging means and said back portion and forces resulted from such contacts are negligable.

12. An arrangement according to claim 1 wherein the portions of the support pillow means positioned between said engaging means and said side edges thereof are interposed at an angle $\alpha$ to a portion of said support pillow means positioned between said engaging means, said angle $\alpha$ corresponds to an angle $\alpha$ of inclination of parts of the back portion positioned between said receiving means and outside edges of the back portion.

13. An arrangement according to claim 11 wherein a recess is provided within a rear surface of said support pillow means to reduce an area of contacts between said support pillow means and said back portion.

14. An arrangement as claimed in claim 7 wherein said seat-back portion combination contacts said base portion along said two substantially horizontal members.

* * * * *